US011462847B2

(12) United States Patent
Koellmann

(10) Patent No.: US 11,462,847 B2
(45) Date of Patent: Oct. 4, 2022

(54) CONDUCTOR TERMINAL

(71) Applicant: WAGO Verwaltungsgesellschaft mbH, Minden (DE)

(72) Inventor: Hans-Josef Koellmann, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 17/382,018

(22) Filed: Jul. 21, 2021

(65) Prior Publication Data

US 2022/0029332 A1 Jan. 27, 2022

(30) Foreign Application Priority Data

Jul. 22, 2020 (DE) ..... 10 2020 119 372.5

(51) Int. Cl.
*H01R 13/11* (2006.01)

(52) U.S. Cl.
CPC ..... *H01R 13/11* (2013.01)

(58) Field of Classification Search
CPC ..... H01R 13/11; H01R 13/10; H01R 13/02; H01R 13/24; H01R 13/15; H01R 13/187; H01R 9/26; H01R 9/2608; H01R 9/2683
USPC ..... 439/733.1, 709
See application file for complete search history.

(56) References Cited

U.S. PATENT DOCUMENTS 7,988,504 B2 * 8/2011 Stromiedel ..... H01R 4/4818 439/809
9,240,650 B2 * 1/2016 Wu ..... H01R 4/4836
10,193,245 B2 * 1/2019 Lorenschat ..... H01R 4/4845
10,230,179 B2 * 3/2019 Wilinski ..... H01R 9/223
10,418,727 B1 * 9/2019 Wu ..... H01R 4/4827
10,686,262 B2 * 6/2020 Wu ..... H01R 4/4818
2008/0096441 A1 * 4/2008 Eppe ..... H01R 4/4827 439/816
2009/0035998 A1 * 2/2009 Schrader ..... H01R 4/4836 439/709
2010/0081316 A1 * 4/2010 Eppe ..... H01R 4/4845 439/441

(Continued)

FOREIGN PATENT DOCUMENTS

DE 1 213 024 B 10/1966
DE 30 19 149 A1 11/1981

(Continued)

*Primary Examiner* — Harshad C Patel
(74) *Attorney, Agent, or Firm* — Muncy, Geissler, Olds & Lowe, P.C.

(57) ABSTRACT

A conductor terminal with an insulating material housing, the insulating material housing having a conductor insertion opening for receiving an electrical conductor in a conductor insertion direction, with a conductor rail section, with a clamping spring, wherein the clamping spring has a clamping leg which, with the conductor rail section, forms a clamping point for the electrical conductor, with a retaining element for holding the clamping leg in an open position of the clamping point, wherein a first latching element is arranged on the clamping leg and a second latching element is arranged on the retaining element, wherein the first and second latching elements can be latched together in the open position of the clamping point, the retaining element and the clamping spring being designed as two components which are separate from one another.

18 Claims, 2 Drawing Sheets

(56) References Cited

U.S. PATENT DOCUMENTS

| | | | | |
|---|---|---|---|---|
| 2011/0183542 | A1* | 7/2011 | Pizzi | H01R 9/2683 439/709 |
| 2013/0095688 | A1* | 4/2013 | Koellmann | H01R 4/4845 439/358 |
| 2016/0190713 | A1* | 6/2016 | Wu | H01R 13/42 439/733.1 |
| 2020/0067212 | A1* | 2/2020 | Koellmann | H01R 4/4836 |
| 2020/0176897 | A1* | 6/2020 | Ober-Woerder | H01R 4/4827 |
| 2020/0243986 | A1* | 7/2020 | Koellmann | H01R 4/52 |
| 2021/0083408 | A1* | 3/2021 | Hartmann | H01R 9/2416 |

FOREIGN PATENT DOCUMENTS

| | | | |
|---|---|---|---|
| EP | 2 768 079 | A1 | 8/2014 |
| EP | 2 947 718 | B1 | 12/2017 |
| WO | WO 2017/214651 | A1 | 12/2017 |

* cited by examiner

CONDUCTOR TERMINAL

This nonprovisional application claims priority under 35 U.S.C. § 119(a) to German Patent Application No. 10 2020 119 372.6, which was filed in Germany on Jul. 22, 2020 and which is herein incorporated by reference.

BACKGROUND OF THE INVENTION

Field of the Invention

The present invention relates to conductor terminal with an insulating material housing, wherein the insulating material housing has a conductor insertion opening for receiving an electrical conductor in a conductor insertion direction, with a conductor rail section, with a clamping spring, wherein the clamping spring has a clamping leg which forms a clamping point for the electrical conductor with the conductor rail section, with a retaining element for holding the clamping leg in an open position of the clamping point, wherein a first latching element is arranged on the clamping leg and a second latching element is arranged on the retaining element, wherein the first and second latching elements can be latched together in the open position of the clamping point, the retaining element and the clamping spring being designed as two components which are separate from one another.

Description of the Background Art

A conductor terminal is known from EP 2 768 079 A1. This is a conductor terminal with the electrical conductor to be connected being automatically connected when it is inserted into the conductor terminal. When the electrical conductor is inserted, the clamping leg of the clamping spring, which is held in an open position, is automatically released, thus causing the electrical conductor to be clamped.

SUMMARY OF THE INVENTION

It is therefore an object of the present invention to provide an improved conductor terminal.

This object is achieved in a conductor terminal of the type mentioned above in that the first latching element and the second latching element are arranged on the side of the clamping leg, which faces away from the clamping point, in the open position of the clamping point. In this way, such a conductor terminal can be improved in terms of operability and reliability with an automatic connection. In particular, an undesired premature release of the latching of the first latching element with the second latching element and thus a premature release of the clamping leg from the open position can be avoided. In addition, secure clamping of the electrical conductor with sufficient overlap of the clamping point can be realized. Furthermore, this ensures collision-free guidance of the electrical conductor, in particular a fine-stranded stranded conductor, without hindering contact with the latching elements.

The clamping leg can have a clamping edge at the free end, which together with the conductor rail section forms the clamping point for the electrical conductor. The electrical conductor is then clamped between the free end of the clamping leg or the clamping edge and the conductor rail section. The first latching element can be arranged directly on the clamping leg or indirectly, for example, via another component on the clamping leg.

A release section can be arranged on the retaining element, wherein the latching of the first and the second latching elements in the open position of the clamping point can be released by applying pressure to the release section in the conductor insertion direction. This allows for the release process of the latching to be easily carried out by means of the release section. The release section can be pressurized, for example, by a separate tool, a component of the conductor terminal, such as an actuating element, or via the electrical conductor itself, thereby releasing the latch. When the latching of the first and second latching elements is released, the clamping leg moves to a closed position of the clamping point as a result of the spring force of the clamping spring. In the closed position, an electrical conductor led to the clamping point is clamped between the free end of the clamping leg and the conductor rail section. If no electrical conductor is inserted, the clamping leg is in contact with the conductor rail section.

The release section can be elastically deflected. During the release process, the release section can be elastically deflected as a result of the pressurization. When the pressurization is ended, the release section springs elastically back to its original position.

The release section and the second latching element can be connected to each other via at least two opposing bends of the retaining element. This allows for the release section of the retaining element to be positioned favorably for secure release, in particular at a relatively large distance from the clamping point and from the second latching element, so that premature release of the latching can be reliably avoided, and secure clamping of the electrical conductor can be ensured.

For example, the retaining element may have a second latching section on which the second latching element is disposed. The second latching section can be connected to the release section via a connecting section of the retaining element. Thereby, at least approximately a right angle may be formed between the second latching section and the connecting section. At least approximately a right angle may be formed between the connecting section and the release section. In this case, it is advantageous if the connecting section has a length which is at least as great as the maximum cross-section of an electrical conductor which can be clamped in the conductor terminal. This provides a relatively large distance between the second latching section and the release section of the retaining element.

A conductor guide channel can be formed in the insulating material housing for guiding the electrical conductor to be clamped at the clamping point, wherein the release section is arranged in the conductor guide channel or at least protrudes into the conductor guide channel. The conductor insertion channel can be formed entirely or partially by the insulating material of the insulating material housing. The conductor insertion channel simplifies the insertion of the electrical conductor into the conductor terminal and the continuation of the electrical conductor to the clamping point and beyond. Due to the fact that the release section is arranged in the conductor insertion channel or at least protrudes into the conductor insertion channel, the release section can be directly pressurized by the electrical conductor when the electrical conductor is inserted into the conductor insertion channel, resulting in an automatic release of the latch. Thus, the user does not have to perform any additional steps for clamping the electrical conductor at the clamping point, since the clamping point is automatically closed due to the electrical conductor pressurizing the release section.

The conductor guide channel can terminate at a bottom wall in the manner of a blind hole, wherein the release section is arranged adjacent to the bottom wall or is at least arranged closer to the bottom wall than to the conductor rail section. The bottom wall may be a part of the insulating material housing. The fact that the release section is arranged relatively close to the bottom wall ensures a large insertion depth of the electrical conductor before the latching is automatically released due to the pressurization of the release section. The free end of the electrical conductor does not strike and actuate the release section until the end of the insertion movement.

The retaining element, in particular the release section of the retaining element, can be arranged behind the conductor rail section in the conductor insertion direction. This ensures a particularly safe release time for the automatic release of the latch via the release section.

The conductor rail section can have a through opening, wherein the electrical conductor to be clamped can be inserted through the through opening. The through opening may be formed, for example, as an aperture or as a through opening made in another manner in the conductor rail section. The electrical conductor thus extends from the conductor insertion opening through the through opening in the conductor rail section to at least the vicinity of the bottom wall of the conductor insertion channel.

The release section of the retaining element can be arranged behind the through opening of the conductor rail section in the conductor insertion direction. In particular, the release section can be arranged at least partially aligned with the through opening of the conductor rail section in the conductor insertion direction. This ensures reliable automatic release of the latch by applying pressure to the release section by means of the inserted electrical conductor.

The through opening can be circumferentially surrounded by a collar at least on one side of the conductor rail section. The collar can in particular be formed from electrically conductive material which is galvanically coupled to the conductor rail section. Then, for example, the clamping point can be arranged on the collar of the conductor rail section or in the transition from the collar to a predominantly flat, plate-shaped region of the conductor rail section. In this case, the collar can surround the through opening over its full circumference (without interruption), or have one or more interruptions, so that the through opening is not surrounded by the collar over its full circumference.

The through opening can be created together with the collar by producing a material passage on the conductor rail section. In this way, an electrically conductive collar integrally formed on the conductor rail section or on its plate-shaped area is produced.

The collar can be arranged on a side of the conductor rail section which faces away from the conductor insertion opening. This allows for the electrical conductor to be securely clamped to the conductor rail section.

The retaining element, in particular the release section of the retaining element, can be arranged behind the clamping point in the conductor insertion direction. This ensures a particularly safe release time for the automatic release of the latch via the release section.

The first latching element can be arranged on a latching tab, wherein the latching tab protrudes from the clamping leg. In this way, the first latching element can be positioned favorably with respect to the second latching element, so that the latching between the first and second latching elements takes place at a point which does not obstruct the insertion of the electrical conductor into the conductor terminal. For example, the latching tab may project from the clamping leg at an angle, e.g., at least approximately at a right angle. The latching tab may be an integrally formed portion of the clamping spring. The latching tab can be formed at least approximately at a right angle.

The latching tab can be designed as a component which is separate from the clamping spring. This offers the advantage that the conductor terminal can be equipped with standard clamping springs, for which only one such latching tab needs to be attached in each case. The latching tab can be made of the same material as the clamping spring or of a different material.

The latching tab and the clamping leg of the clamping spring can be connected to each other by means of a force-fitting and/or form-fitting connection. This permits a wide range of possibilities for connecting the latching tab to the clamping leg. Advantageous are, for example, a clinch joint, a welded joint, a soldered joint and/or an adhesive joint for connecting the latching tab to the clamping leg. A rivet joint is also conceivable.

The conductor terminal can have an actuating element for opening the clamping point. By means of such an actuating element, which is part of the conductor terminal, the user can easily open the clamping point by deflecting the clamping leg to such an extent that the clamping point is opened. In this case, the actuating element can be designed in such a way that it is suitable for deflecting the clamping leg into the latching position, i.e., that the first latching element and the second latching element latch together, or the clamping leg can only be moved by the actuating element into a less deflected position in which latching does not yet occur.

An advantage of such an actuating element, which is part of the conductor terminal, is that the user does not need a separate tool to open the clamping point. The actuating element can, for example, be designed as a pusher, e.g., as a predominantly linearly movable pusher, or as a pivotable lever, or as a combination thereof.

At least one projection can protrude from the insulating material housing into the interior of the insulating material housing, wherein the clamping spring and/or the retaining element are mounted on the projection. This permits secure mounting and fastening of the clamping spring and/or the retaining section in the insulating material housing. The insulating material housing can have a projection for mounting the clamping spring and another projection for mounting the retaining section.

Starting from the clamping leg, the clamping spring can be formed in such a way that it merges into a spring arc and a contact leg adjoins the spring arc, which serves to contact and fix the clamping spring to a part of the conductor terminal, e.g., to the conductor rail section and/or an area of the insulating material housing. If the conductor rail section has the aforementioned through opening, the contact leg can be suspended in the through opening, for example.

For the purposes of the present invention, the indefinite term "a" is not to be understood as a numeral. Thus, if, for example, a component is mentioned, this is to be interpreted in the sense of "at least one component". Insofar as angle specifications are made in degrees, these refer to a circular dimension of 360 degrees (360°).

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
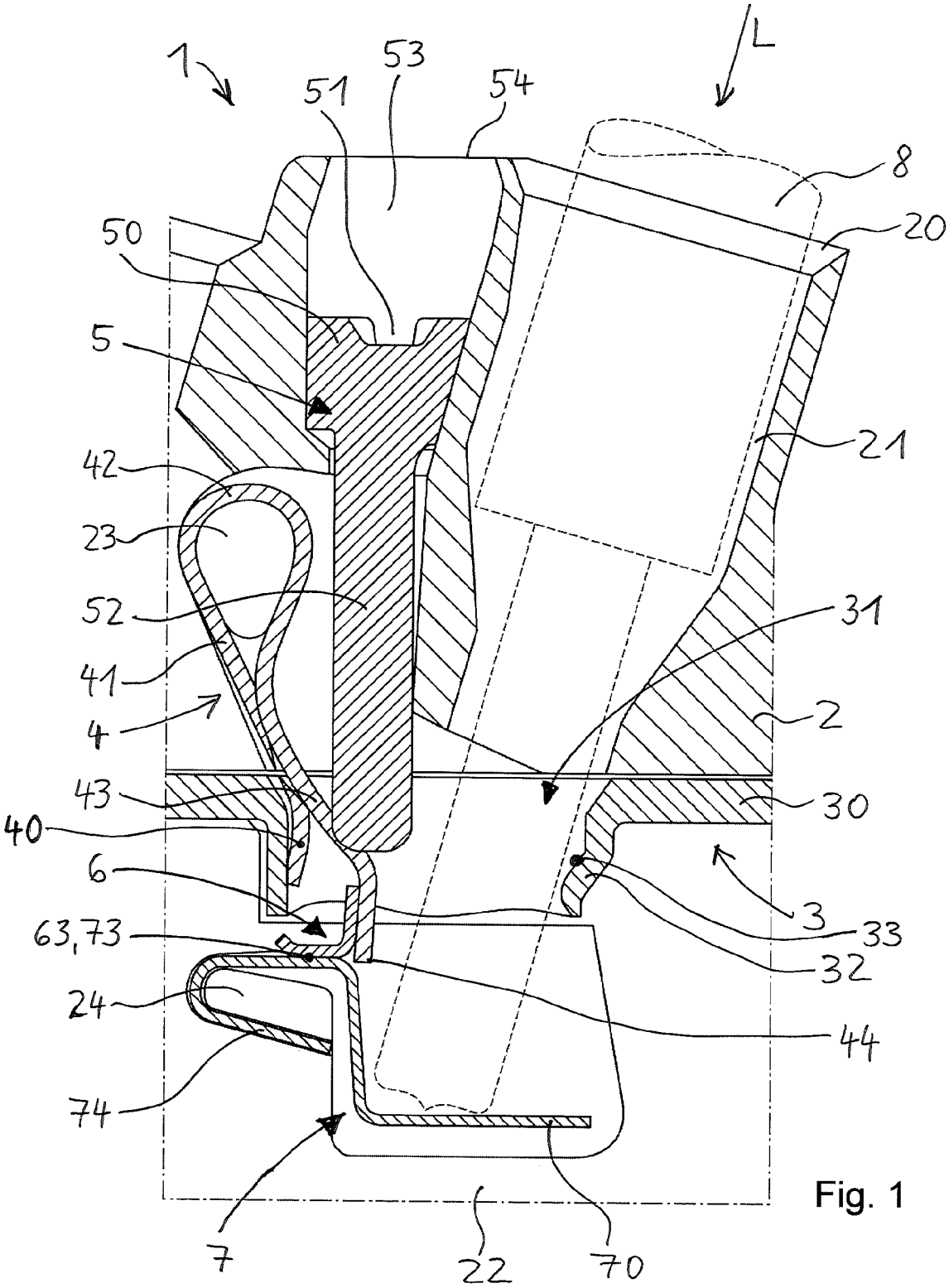
FIG. 1 shows a conductor terminal in a partially cut side view.

The conductor terminal 1 shown in FIG.1 has an insulating material housing 2. The insulating material housing 2 has a conductor insertion opening 20, to which a conductor guide channel 21 is connected inside the insulating material housing 2. The conductor insertion channel 21 has side walls formed from the insulating material of the insulating material housing 2, wherein parts of the conductor insertion channel 21 may also be formed by other parts of the conductor terminal 1, such as a conductor rail section 3. The conductor insertion channel 21 terminates in a blind hole manner at a bottom wall 22 of the insulating material housing 2. An electric conductor 8 can be inserted through the conductor insertion opening 20 and the conductor insertion channel 21 in a conductor insertion direction L to a clamping point formed by the conductor rail section 3 and a clamping leg 43 of a clamping spring 4, and slightly beyond.

The conductor terminal 1 has a conductor rail section 3 and a clamping spring 4 as parts of an electrical contact insert. The conductor rail section 3 has an at least predominantly flat, plate-shaped main section 30 in which a through opening 31 is formed. The through opening 31 is circumferentially surrounded by a collar 32 on the side of the conductor rail section 3 which faces away from the conductor insertion opening 20. The through opening 31 may be formed together with the collar 32 in the form of a material passage. The conductor guide channel 21 extends through the through opening 31 and the collar 32 to the bottom wall 22.

The clamping spring has a contact leg 41, a spring arc 42 adjoining the contact leg 41 and a clamping leg 43 adjoining the spring arc 42. The clamping leg 43 ends at its free end with a clamping edge 44. The abutment leg 41 serves to support the clamping spring 4 with respect to the spring force acting on the clamping leg 43 and accordingly to fix the clamping spring 4 in the insulating material housing 2. The abutment leg 41 may have an end portion 40 at its free end, with which the abutment leg 41 is hooked into the through opening 31 or inside the collar 32. The end portion 40 may, for example, be bent at a certain angle with respect to the portion of the abutment leg 41 adjacent to the spring arc 42. In the insulating material housing 2, there may be a projection 23 formed from the material of the insulating material housing 2, which may be shaped, for example, similarly to a profile body and may serve to additionally fix the clamping spring 4 and/or as a travel limit for a maximum deflection of the clamping leg 43.

In the conductor terminal 1, a clamping point for clamping an electrical conductor 8 placed in the conductor guide channel is provided between the free end of the clamping leg 43 (clamping edge 44) and the conductor rail section 3, wherein on the conductor rail section 3 the clamping point may be formed, for example, on the inside of the collar 32, for example, in a clamping point area 33.

As an optionally provided further component, the illustrated conductor terminal 1 can have an actuating element 5 with which the user can open the clamping point by manually actuating the actuating element 5 by deflecting the clamping leg 43 via the actuating element 5. The actuating element 5 may be designed, for example, as an actuating pusher. The insulating material housing 2 can have an actuation opening 54, to which an actuating channel 53 can be connected. The actuating channel 53 serves to receive and support as well as guide the actuating element 5 in the insulating material housing 2.

The actuating element 5 has a manual actuation area 50, e.g., a head area, which can have, for example, a recess 51, to which a user can apply an actuating tool, e.g., a screwdriver, for actuation. From the manual actuation area 50, the actuation element 5 extends with a plunger area 52 to the clamping leg 43. At its free end, the plunger area 52 comes into mechanical contact with the clamping leg 43 to deflect the latter. FIG. 1 shows the actuating element 5 in an actuated position, in which the actuating element 5 is shifted a little to the left as compared to the unactuated position. Hereby, via the plunger 52, the clamping leg 43 is deflected to such an extent that it is distanced from the clamping point area 33 of the conductor rail section 3. In the unactuated position, the clamping leg 43 would rest with its free end against the clamping point area 33 or, if an electrical conductor 8 were inserted, against the electrical conductor.

The conductor terminal 1 has a latching tab 6 and a retaining element 7 as further elements. A first latching element 63 is provided on the latching tab 6, and a second latching element 73 is provided on the retaining element 7. The first and second latching elements 63, 73 are associated with one another in terms of their shapes, so that they can be latched together in the open position of the clamping point, as shown in FIG. 1.

The retaining element 7 also has a release section 70. If the release section 70 is subjected to pressure in the conductor insertion direction L, e.g., by means of the end of the electrical conductor 8, the release section 70 can be elastically deflected, thereby causing the latching of the first and second latching elements 63, 73 to be released. After the latching has been released, the clamping leg 43 can spring back due to its spring force and then rests either against the inserted electrical conductor 8 or, if no electrical conductor 8 is inserted, against the conductor rail section 3.

The retaining element 7 may have a second fastening section 74, by means of which it is fastened in the conductor terminal. The second fastening section 74 may be fastened, for example, in a groove formed between a wall of the insulating material housing 2 and a further projection 24, wherein the second fastening section 74 may be received in the groove in a form-fitting and/or force-fitting manner.

Figure 2:
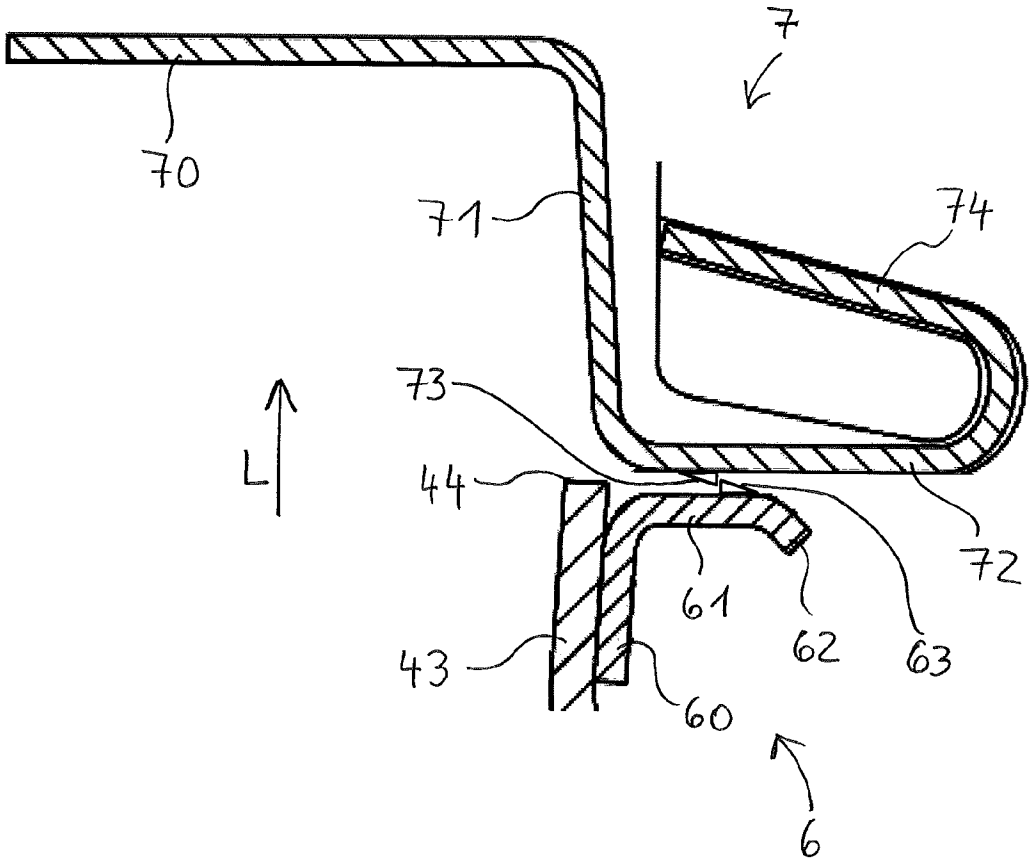
FIG. 2 shows the interaction between the first and second latching elements in enlarged detail.

FIG. 2 shows the latching tab 6 and the retaining element 7 and their interaction in an enlarged view without the other elements of the conductor terminal 1. It can be seen that the latching tab 6 may have a first fastening section 60 and a first latching section 61 angled relative to the first fastening section 60. The first fastening section 60 is used to fasten the latching tab 6 to the clamping leg 43, for example by welding, soldering, riveting and/or gluing. Particularly advantageously, the connection between the clamping leg 43 and the fastening section can also be produced by means of a clinching process. In this case, it is advantageous to connect the latching tab 6 to the clamping leg 43 on the side of the clamping leg 43 which faces away from the clamping point.

The first latching section 61 may have an angled end portion 62 at the free end. This prevents catching or jamming on the retaining element 70 when moving the clamping leg 43 with the latching tab 6 into the open position. Furthermore, the latching tab 6 has the first latching element 63 in the first latching section 61.

The retaining element 7 has the aforementioned release section 70. The release section 70 is connected to a second latching section 72 of the retaining element 7 via a connecting section 71. The second latching section 72 merges into the aforementioned second fastening section 74 of the retaining element 7. The second latching element 73 is arranged on the second latching section 72. It can be seen that the retaining element 7 can have a kind of S-shape or oppositely angled shape with respect to the shape of the release section 70, the connecting section 71 and the second latching section 72. In this regard, the angle between the release section 70 and the connecting section 71 may be at least approximately a right angle, and the angle between the connecting section 71 and the second latching section 72 may be at least approximately a right angle.

In general, it should be said that deviations from the rectangular design are also possible, e.g., in the range of +/−20 degrees.

If pressure is now applied to the release section 70 in the conductor insertion direction L or at least approximately at right angles to the longitudinal extension direction of the release section 70, this simultaneously deflects the connecting section 71 and thereby the second latching section 72, causing the second latching element 73 to be moved away from the first latching element 63, so that from a certain point onwards the first and second latching elements 63, 73 are no longer in engagement with each other. This releases the latch.

In the illustrated embodiment, the first and second latching elements 62, 73 are each shown as protruding from the respective latching section 61, 72. The first and second latching elements 63, 73 can also be designed differently, e.g., as a projecting latching nose on one side and as a detent recess or latching edge on the other side.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A conductor terminal comprising:

an insulating material housing having a conductor insertion opening for receiving an electrical conductor in a conductor insertion direction;

a conductor rail section;

a clamping spring having a clamping leg which, with the conductor rail section, forms a clamping point for the electrical conductor;

a retaining element for holding the clamping leg in an open position of the clamping point;

a first latching element arranged on the clamping leg; and a second latching element arranged on the retaining element, wherein the first and the second latching elements are adapted to be latched together in the open position of the clamping point, wherein the retaining element and the clamping spring are designed as two components separate from one another, and wherein, in an open position of the clamping point, the first latching element and the second latching element are arranged on a side of the clamping leg that faces away from the clamping point.

2. The conductor terminal according to claim 1, wherein a release section is arranged on the retaining element, it being possible to release the latching of the first and second latching elements in an open position of the clamping point by applying pressure to the release section in the conductor insertion direction.

3. The conductor terminal according to claim 2, wherein the release section and the second latching element are connected to each other via at least two opposing bends of the retaining element.

4. The conductor terminal according to claim 2, wherein a conductor guide channel is formed in the insulating material housing for guiding the electrical conductor to be clamped at the clamping point, wherein the release section is arranged in the conductor guide channel or at least protrudes into the conductor guide channel.

5. The conductor terminal according to claim 4, wherein the conductor guide channel terminates at a bottom wall in the manner of a blind hole, the release section being arranged adjacent to the bottom wall or at least being arranged closer to the bottom wall than to the conductor rail section.

6. The conductor terminal according to claim 1, wherein the retaining element, in particular the release section of the retaining element, is arranged behind the conductor rail section in the conductor insertion direction.

7. The conductor terminal according to claim 1, wherein the conductor rail section has a through opening, and wherein the electrical conductor to be clamped is insertable through the through opening.

8. The conductor terminal according to claim 7, wherein the release section of the retaining element is arranged behind the through opening of the conductor rail section in the conductor insertion direction.

9. The conductor terminal according to claim 7, wherein the through opening is circumferentially surrounded by a collar at least on one side of the conductor rail section.

10. The conductor terminal according to claim 9, wherein the collar is arranged on a side of the conductor rail section which faces away from the conductor insertion opening.

11. The conductor terminal according to claim 1, wherein the retaining element, in particular the release section of the retaining element, is arranged behind the clamping point in the conductor insertion direction.

12. The conductor terminal according to claim 1, wherein the first latching element is arranged on a latching tab, and wherein the latching tab protrudes from the clamping leg.

13. The conductor terminal according to claim 12, wherein the latching tab is formed at least approximately at right angles.

14. The conductor terminal according to claim 12, wherein the latching tab is designed as a component which is separate from the clamping spring.

15. The conductor terminal according to claim 14, wherein the latching tab and the clamping leg of the clamping spring are connected to one another via a force-fitting and/or a form-fitting connection.

16. The conductor terminal according to claim 15, wherein the latching tab is connected to the clamping leg via a welded connection and/or an adhesive connection.

17. The conductor terminal according to claim 1, wherein the conductor terminal has an actuating element for opening the clamping point.

18. The conductor terminal according to claim 1, wherein at least one projection protrudes from the insulating material housing into an interior of the insulating material housing, and wherein the clamping spring and/or the retaining element are mounted on the projection.

* * * * *